United States Patent [19]

Herold et al.

[11] Patent Number: 4,805,533

[45] Date of Patent: Feb. 21, 1989

[54] SWIMMER PYROTECHNIC SIGNAL DEVICE

[75] Inventors: Stanley J. Herold, Switz City; Donald E. LaGrange, Washington; Thomas R. Limberger, Bloomington; James F. Taylor, Lyons, all of Ind.

[73] Assignee: The United States of America as Represented by the Secretary of the Navy, Washington, D.C.

[21] Appl. No.: 136,613

[22] Filed: Dec. 21, 1987

[51] Int. Cl.[4] ..... F42B 4/26

[52] U.S. Cl. ..... 102/341; 102/342; 102/218; 102/275.6

[58] Field of Search ..... 102/341, 275.3, 275.6, 102/275.9, 275.11, 275.14, 342, 218

[56] References Cited

U.S. PATENT DOCUMENTS

| | | | |
|---|---|---|---|
| 58,639 | 10/1866 | Hagenmeyer | 102/275.11 |
| 3,399,621 | 9/1968 | Schillreff | 102/37.8 |
| 3,483,312 | 12/1969 | McDonald et al. | 174/87 |
| 3,614,542 | 10/1971 | Coyle | 102/218 X |
| 3,759,216 | 9/1973 | Sanders | 116/124 B |
| 3,898,609 | 8/1975 | Charles | 340/4 R |
| 3,908,550 | 9/1975 | Beatty | 102/37.4 |
| 3,910,190 | 10/1975 | Dare | 102/37.4 |
| 3,954,059 | 5/1976 | Langseth | 102/341 X |
| 4,335,656 | 6/1982 | Beatty | 102/340 |
| 4,439,341 | 3/1984 | Swiatosz | 252/305 |

FOREIGN PATENT DOCUMENTS

| | | | |
|---|---|---|---|
| 2755258 | 7/1978 | Fed. Rep. of Germany | 102/341 |
| 1314811 | 4/1973 | United Kingdom | 102/341 |

*Primary Examiner*—Peter A. Nelson
*Attorney, Agent, or Firm*—William C. Townsend; Harvey A. David

[57] ABSTRACT

A swimmer distress signal of the smoke or flare type has an ignition system which can be operated with one hand. A stab primer is activated by a sliding firing pin that is normally locked in position and protected by a metal cover. Upon withdrawal of the signal from a pouch, a lanyard pulls off the cover to expose and unlock the firing pin which has an enlarged head. A hit or force on the firing pin head drives it into the primer to ignite the display.

1 Claim, 3 Drawing Sheets

SWIMMER PYROTECHNIC SIGNAL DEVICE

BACKGROUND OF THE INVENTION

This invention relates to the field of underwater flare or smoke producing signal devices, and more particularly to such devices that are adapted to be safely carried and easily ignited by swimmers or by divers for use as hand held signaling means.

Underwater signal flares or smoke generating devices have generally required the use of two hands to effect ignition, i.e., one hand to hold the device and the other to pull a ring to allow a spring actuated firing mechanism to operate or to actuate a friction igniter. This can be quite difficult in cold water situations, particularly when wearing bulky divers gloves or mittens, and may be impossible if the diver or swimmer is in a distress situation precluding use of more than one hand. In addition, spring actuated firing mechanisms tend to become unreliable when carried in the saltwater, sand, and silt environments frequented by working divers.

SUMMARY OF THE INVENTION

With the foregoing in mind, it is a principal object of this invention to provide an improved pyrotechnic signal device that is easier and more reliable to use, particularly with a cold or mittened hand.

Another and important object of the invention is to provide a diver's signal device that is accessible, made ready to ignite, and actually ignited using only one hand.

As another object the invention aims to accomplish the above by providing a signal device usable either in water or air and wherein simple removal or withdrawal of the device from a carrying pouch places the device in an armed condition such that only a simple striking or bumping action is required to effect ignition rather than grasping and pulling as in the prior art.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
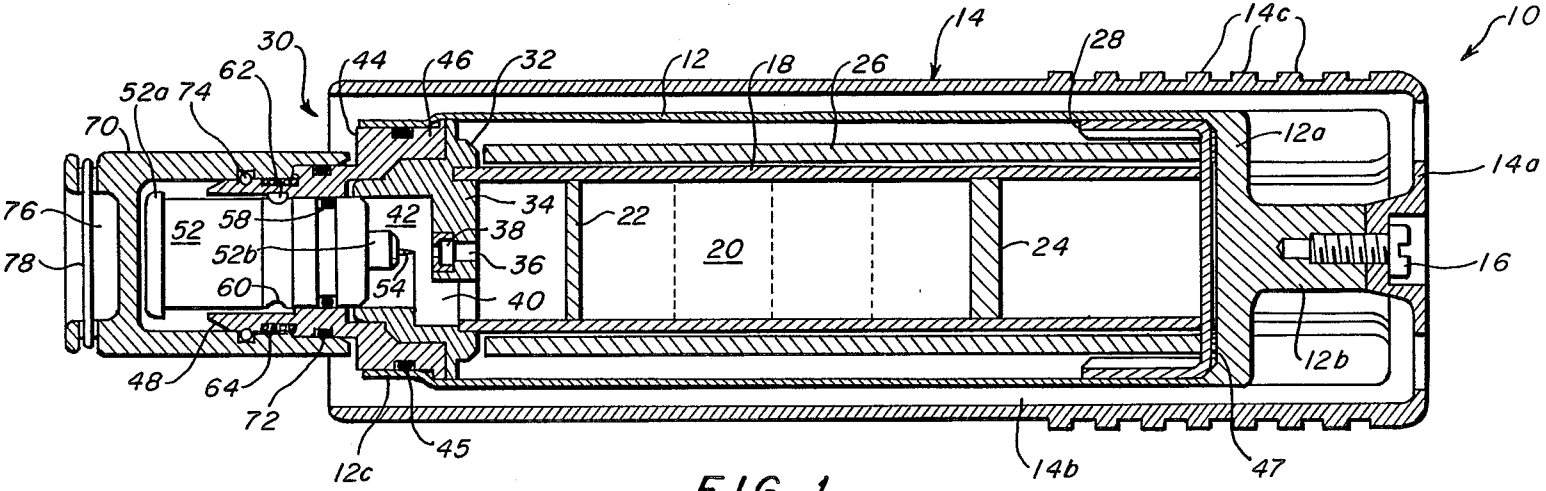
FIG. 1 is a longitudinal sectional view of a pyrotechnic flare signal device embodying the invention.
Figure 2:
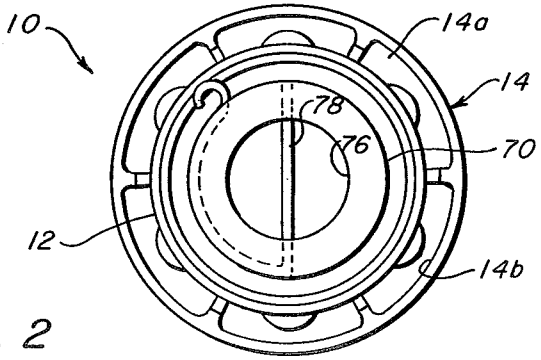
FIG. 2 is an end elevational view of the device of FIG. 1.

In the form of the invention illustrated in the drawings, and referring first to FIGS. 1 and 2, a flare or signal device 10 comprises a tubular flare case 12 which has a closed end wall 12*a* and is received within a hollow grip member indicated generally at 14. The grip member 14 has an apertured end wall 14*a*, a cylindrical side wall having longitudinal flutes 14*b* defined in the inner surface thereof, and circumferential ribs 14*c* on the outer side wall surface portion adjacent end wall 14*a*. A stand-off boss 12*b* extends axially from the flare case end wall 12*a* and is secured by a screw 16 to the apertured end wall 14*a* of the grip member 14.

Confined within the case 12 is a flare candle comprising a candle tube 18 containing pyrotechnic material 20 between plugs or wads 22, 24. An insulative sheath 26 surrounds the tube 18 which is confined in the case 12 between a cup-shaped holder 28 and an ignition assembly, generally indicated at 30.

The ignition assembly 30 includes a primer carrier 32 that comprises a body adapted to receive the end of candle tube 18 adjacent wad 22 and has a wall portion 34 having a stepped bore 36 in which is seated a percussion primer cap 38. The primer carrier 32 is further provided with a passage 40 communicating between the interior of the candle tube 18 and an enlarged bore 42 of the primer carrier body.

A firing pin carrier 44 has an annular end portion 46 telescoped over the primer carrier 30 and fixed within the end of the flare case 12, as by constrictive crimping or otherwise forming the end portion 12*c* of the flare case into gripping relation to the firing pin carrier, with a sealing ring 45 therebetween. A wave spring washer 47 is disposed between the flare case end wall 12*a* and the bottom of the holder 28 to urge the flare candle tube 18 into snug engagement with the primer carrier 34. Extending from the end portion 46 is a reduced, tubular portion 48 having a bore 50 aligned with the bore 42 of the primer carrier 32. A firing pin 52 is reciprocably disposed in bore 50 and has an outer end portion with an enlarged head 52*a* extending outwardly beyond the carrier tubular portion 48, and a reduced inner end portion 52*b* carrying a primer piercing point 54. The firing pin 52 further comprises an annular groove carrying a sliding O-ring seal 58 that seals the firing pin 52 relative to the inner end of bore 50. Pin 52 also has an annular recess 60 adapted to receive the inner end of a detent pin 62 that is carried in an opening in the tubular portion 48 and which is resiliently biased radially inwardly by a spring retaining clip 64. The detent pin 62 under the influence of clip 64 serves to cooperate with recess 60 to releasably hold the firing pin 52 in its illustrated position with a space between the point 54 and the primer 38.

A removable, firing pin cover 70 is disposed in capping relation to the tubular portion 48 of the firing pin carrier. The cover 70 cooperates with an O-ring seal 72 to prevent water entry into or past the firing pin assembly 30. The cover 70 is releasably held in its closing position by a resilient locking ring 74 that snaps into or out of an annular recess around the tubular portion 48 of the firing pin carrier. With the cover in its closing position, the retaining clip 64 is confined and the detent pin 52 is prevented from moving radially outwardly. Accordingly, with the cover 70 in place, the firing pin 52 is held against any reciprocal movement that might initiate ignition inadvertently due to mechanical shock. The outer end of cover 70 is recessed at 76 and provided with a wire clip 78 for attachment of a loop of a lanyard as will be described with reference to FIG. 3. Moreover, with the cover 70 in place, water entry to the interior of the candle tube 18 is barred by seals 72 and 58, in series.

Figure 3:
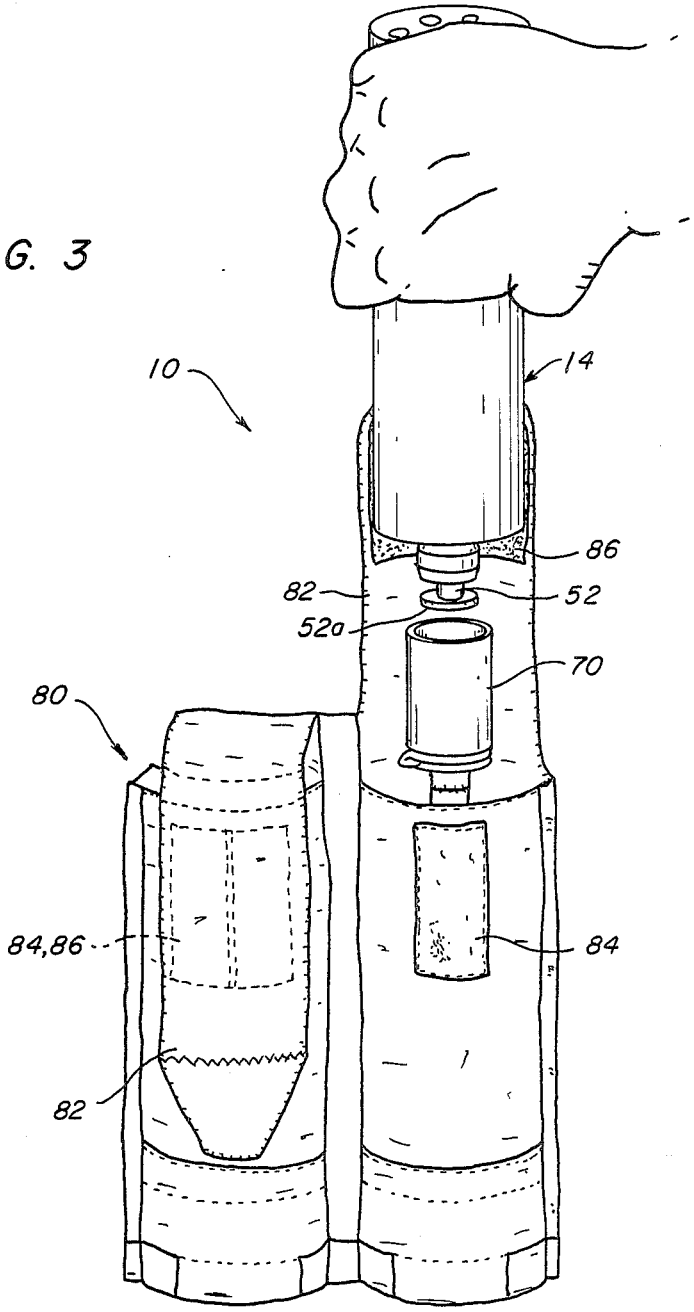
FIG. 3 is an elevational view illustrating a storage pouch and manner of withdrawal of a signal device.

Referring now to FIG. 3, the signal device 10 is shown being withdrawn from a carrying pouch 80, in which in this example has spaces for two such signal devices and can be conveniently carried on a diver's or swimmer's belt. The pouch 80 comprises flaps or closures 82 that are adapted to be releasably held in closed positions by hook and loop patches 84, 86. A lanyard 88, having a looped end engaged by clip 78, is secured at its other end in the pouch and serves to overcome the resistance of ring 74 so as to remove cap 70 upon withdrawal of the signal device 10 from the pouch, thereby exposing the enlarged head 52*a* of the firing pin 52. Removal of cap 70 also renders the spring retaining clip 64 for detent pin 62 free to expand upon outward movement of the detent pin.

Figure 4:
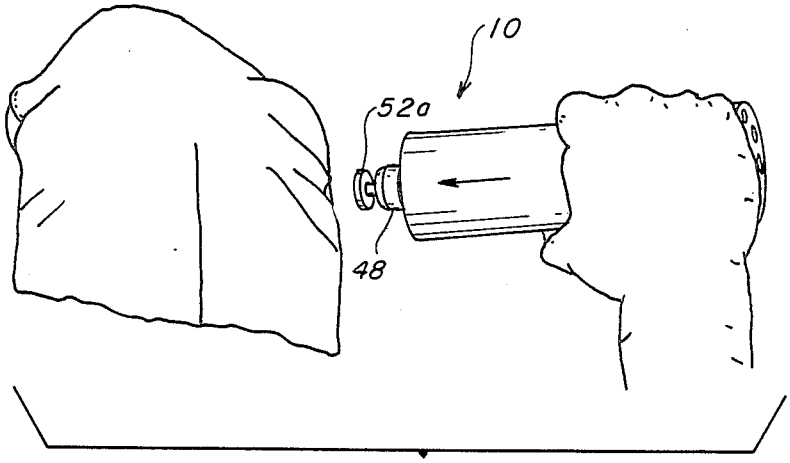
FIGS. 4 and 5 illustrate steps of striking of the firing pin to effect ignition and subsequent explusion of the firing pin.
Figure 5:
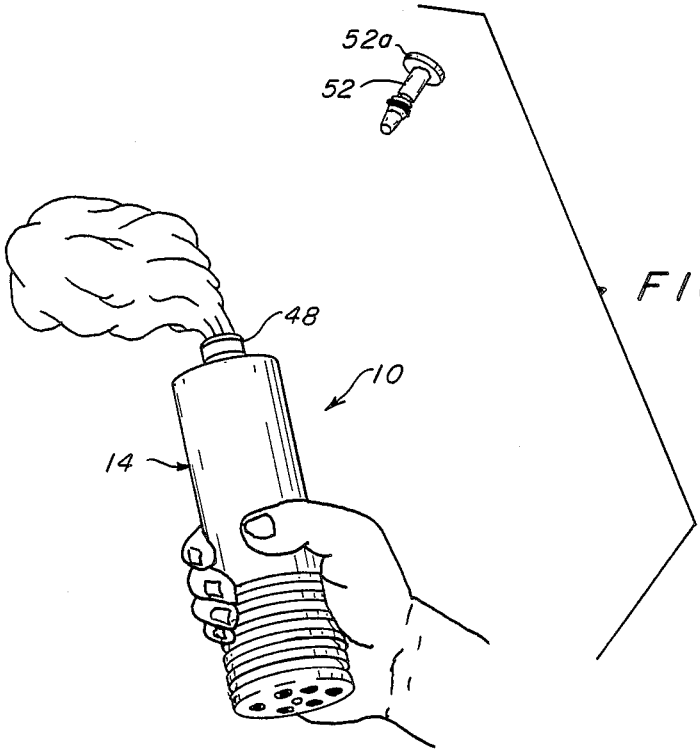

With the device 10 withdrawn and cap 70 removed, the signal can be readily ignited by simply striking the head 52*a* of the firing pin axially against the knee or other object, as shown in FIG. 4, so as to drive the pointed end 54 thereof into the primer 38. The primer is thereby ignited and produces a flame that burns through wad 22 and ignites the flare candle pyrotechnic material 20. The resulting gaseous products produce sufficient pressure acting against the firing pin 52 to expel it from bore 50 so as to allow smoke and/or flare flame 90 to exit freely through passages 40, 42 and bore 50, as is illustrated in FIG. 5.

The apertured wall 14*a* and flutes 14*b* of grip 14 allow water or air to circulate around and over the flare case 12 to prevent the grip from becoming too hot to hold comfortably or safely.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. A pyrotechnic signal device for use by swimmers or divers, said device comprising:

a tubular case;

pyrotechnic candle means disposed in said tubular case;

ignition means, fixed in one end of said tubular case, for blocking water entry to said pyrotechnic candle means during periods of non-use and operable by-bumping or striking a portion of said ignition means against a relatively stationary surface to effect ignition of said pyrotechnic candle means, said ignition means comprising a primer carrier comprising a first body mounted in one end of said tubular case adjacent said pyrotechnic candle means, said body having a first bore that is stepped to define a seat for a primer charge, and a radially offset passage communicating between said pyrotechnic candle and said first bore, a firing pin carrier comprising a second body fixed in said end of said tubular case and having a second bore axially aligned with said first bore, a firing pin disposed for axial movement between first and second positions in said aligned first and second bores, said firing pin having a point adapted to engage and pierce said primer charge, detent means for releasably holding said firing pin in said first position with said point spaced from said primer charge, said detent means being yieldable to predetermined axial force by said bumping or striking on said firing pin to release said firing pin for movement to said second position to effect ignition of said primer, said detent means comprising a spring clip having a circular portion having a contracted position for holding said firing pin against inadvertent axial movement and an expanded position for allowing axial movement of said firing pin, and cover means normally confining said spring clip in said contracted position and removable to allow movement to said expanded position;

a carrying pouch; and lanyard means connected between said carrying pouch and said cover means for effecting removal of said cover means upon movement of said signal device from said pouch beyond the limit of said lanyard means.

* * * * *